US006183067B1

(12) United States Patent
Matta

(10) Patent No.: US 6,183,067 B1
(45) Date of Patent: Feb. 6, 2001

(54) INKJET PRINTHEAD AND FABRICATION METHOD FOR INTEGRATING AN ACTUATOR AND FIRING CHAMBER

(75) Inventor: Farid Matta, Los Altos, CA (US)

(73) Assignee: Agilent Technologies, Palo Alto, CA (US)

( * ) Notice: Under 35 U.S.C. 154(b), the term of this patent shall be extended for 0 days.

(21) Appl. No.: 08/787,534

(22) Filed: Jan. 21, 1997

(51) Int. Cl.[7] ..... B41J 2/04
(52) U.S. Cl. ..... 347/65; 347/63
(58) Field of Search ..... 347/65, 63, 85, 347/47, 62, 59, 94

(56) References Cited

U.S. PATENT DOCUMENTS

| | | | | |
|---|---|---|---|---|
| 4,312,008 | * | 1/1982 | Taub | 347/71 |
| 4,914,736 | * | 4/1990 | Matsuda | 347/63 |
| 5,016,024 | | 5/1991 | Lam et al. | 346/1.1 |
| 5,122,812 | * | 6/1992 | Hess | 347/59 |
| 5,160,577 | * | 11/1992 | Deshpande | 347/63 X |
| 5,305,015 | * | 4/1994 | Schantz | 347/47 |
| 5,388,326 | | 2/1995 | Beeson et al. | 29/611 |
| 5,412,412 | | 5/1995 | Drake et al. | 347/40 |
| 5,450,109 | | 9/1995 | Hock | 347/67 |
| 5,450,113 | | 9/1995 | Childers et al. | 347/87 |
| 5,484,507 | * | 1/1996 | Ames | 347/47 X |
| 5,502,471 | * | 3/1996 | Obermeier | 347/65 |
| 5,565,900 | * | 10/1996 | Cowger | 347/42 |
| 5,602,576 | * | 2/1997 | Murooka | 347/59 |
| 5,841,452 | * | 11/1998 | Silverbrook | 347/59 X |

FOREIGN PATENT DOCUMENTS

| | | | | |
|---|---|---|---|---|
| 436 047 | * | 7/1991 | (EP) | B41J/2/05 |
| 40 25 619 | * | 2/1992 | (EP) | B41J/2/05 |
| 62-94347 | | 4/1987 | (JP) | B41J/3/04 |

* cited by examiner

*Primary Examiner*—John Barlow
*Assistant Examiner*—Helen Mahoney

(57) ABSTRACT

An inkjet printhead and fabrication method include integrating actuators and ink firing chambers on a single substrate, such as a semiconductor substrate. The integration process utilizes semiconductor-on-insulator (SOI) techniques in the preferred embodiment. Actuators are formed on one surface of the substrate, typically a silicon substrate, and firing chambers are aligned with the actuators. Electrical switching devices, such as transistors, are formed along the surface and are utilized to individually address the actuators. After the integrated structure is formed, a supply manifold may be attached to the structure for replenishing fluid ink following a firing operation. Optionally, a flow control mechanism, such as a valve, may be incorporated between the manifold and the firing chamber.

4 Claims, 5 Drawing Sheets

INKJET PRINTHEAD AND FABRICATION METHOD FOR INTEGRATING AN ACTUATOR AND FIRING CHAMBER

TECHNICAL FIELD

The invention relates generally to inkjet printheads and more particularly to forming a mechanism for projecting fluid ink from a printhead.

BACKGROUND ART

Thermal inkjet printheads include an array of ink firing chambers having openings from which ink is projected onto a sheet of paper or other medium. Each ink firing chamber is aligned with a thermal actuator, i.e., a resistive heater. Current flow through the actuator causes a portion of the ink within the firing chamber to vaporize and eject an ink drop through the opening. The openings are arranged in linear arrays along a surface of the printhead.

With reference to FIG. 1, a prior art thermal inkjet printhead is schematically shown as including a silicon substrate 10 and a polymer barrier layer 12. Formed on the silicon substrate is a resistor layer 14 and a metallization layer 16. The resistor layer is patterned to define dimensions and locations of ink firing actuators 18. While not shown in FIG. 1, the metallization layer extends beyond the actuator and provides an electrical path for control signals to the actuator. A passivation layer 20 is disposed over the metallization layer, and the polymer barrier layer 12 is attached to the passivation layer. The polymer barrier layer is patterned to include an ink firing chamber that exposes the thermal actuator 18. The barrier layer 12 includes an open side 22 that is in fluid communication with an ink supply channel.

Referring now to FIGS. 1 and 2, atop the barrier layer 12 is an orifice substrate 24 having an opening 26. In practice, the barrier layer 12 is often formed in conjunction with the orifice substrate 24. The opening 26 defines the geometry for firing ink from the inkjet mechanism in response to activation of the thermal actuator 18. The actuator is individually addressed by means of a switching transistor 28 connected to the actuator by a conductive trace 30.

In operation, current flow through the thermal actuator 18 is initiated by the electronic circuitry 28. As the actuator heats, a vapor bubble is formed in the firing chamber and a pressure field is generated. As a result, ink is projected from the firing chamber toward a medium, such as a sheet of paper. The firing chamber is replenished with ink by flow from a supply channel 32 of the silicon substrate 10. The ink enters the firing chamber through the open side 22 of the barrier layer 12.

As explained in U.S. Pat. No. 5,450,109 to Hock, which is assigned to the assignee of the present invention, the conventional method of fabricating inkjet printheads is to utilize photolithographic techniques to form the thermal actuators 18 on the silicon substrate 10. Separately, the ink firing chambers are photolithographically defined within the polymer barrier layer 12 that is formed on the orifice substrate 24. The orifice substrate may be formed of a gold-plated nickel material. The orifice substrate and barrier layer are then attached to the actuator substrate 10 with the firing chambers in precise alignment with the actuators.

Utilizing conventional fabrication techniques, the inkjet printhead includes three structures, i.e., the silicon substrate with the thermal actuators, the barrier layer in which the ink supply channels and firing chambers are formed, and the orifice plate having the openings for the projection of ink.

Often, the manufacturing process includes adhering two substrates together to provide the final product. Adhering the substrates in order to provide the desired architecture raises concerns with respect to reliability, cost, manufacturability and print quality. Improved print quality requires smaller ink drop volumes and, therefore, smaller ink firing chambers and openings. As ink firing chambers and thermal actuators are reduced in size, it becomes increasingly difficult to properly align the array of ink firing chambers on one substrate with the array of thermal actuators on another substrate. Limits imposed by the ability to repeatedly and reliably align the two substrates are factors in dictating the throughput, cost and print quality available using inkjet technology. Another limitation of the bonded structure stems from the fact that adhesives tend to fail due to long-term exposure to aggressive inks and thermal cycling. Repeated heating and cooling, as well as contact with chemically aggressive inks, often cause degradation of the polymer barrier layer and loss of adhesive properties. Partial or total delamination of the orifice substrate from the actuator substrate may result.

U.S. Pat. No. 5,412,412 to Drake et al. describes the procedure for bonding the substrates as being paramount to maintaining the efficiency, consistency and reliability of an inkjet printhead. The alignment and bonding process described in Drake et al. includes introducing elements into the fabrication sequence to compensate for any topographical formations that are developed in a thick film insulating layer during fabrication. The insulating layer is formed to intentionally include a non-functional heater pit and a non-functional bypass recess. The non-functional features are on opposite sides of arrays of functional heater pits and bypass recesses. In like manner, a silicon substrate is formed to include non-functional grooves that are positioned to straddle topographical formations formed proximate to the non-functional heater pits and bypass recesses formed in the insulating layer. Therefore, the topographical formations do not cause the silicon substrate to stand off from the thick film insulating layer.

Another patent that addresses the process of connecting two substrates in forming an inkjet printhead is U.S. Pat. No. 5,388,326 to Beeson et al., which is assigned to the assignee of the present invention. The first substrate includes inkjet nozzles and an array of conductive traces that are formed in a preselected pattern. The second substrate is a "die layout" having a barrier material, an array of resistors formed in wells within the barrier material, and an array of channels formed in the barrier material. The positions of the resistors and the channels of the die layout match the positions of the inkjet nozzles and the conductive traces, respectively. By interlocking the conductive traces with the channels, the resistors are aligned with the inkjet nozzles. The first substrate and the barrier material are then laminated so as to bond the two together.

While the prior art techniques for bonding substrates of an inkjet printhead provide acceptable results, further improvements are desired in order to accommodate advancements with respect to print quality, printhead reliability, manufacturing throughput, and cost reduction. Moreover, a major source of printhead failures continues to be delamination of the orifice substrate from the actuator substrate. As previously noted, the substrate-to-substrate bonds tend to fail due to the long-term exposure to thermal cycling. U.S. Pat. No. 5,016,024 to Lam et al. provided a degree of improvement by forming heaters adjacent to the orifices on an orifice plate. An ink reservoir wall is connected in parallel with the orifice plate. An ink heating zone for a particular orifice is provided by a gap between the ink reservoir wall and the orifice plate. Electrical current through a heater rapidly heats the volume of ink in the adjacent ink heating zone, forming a bubble for projecting ink through the orifice. While the Lam et al. printhead reduces substrate-to-substrate alignment requirements, substrate delamination remains a concern, since the ink heating zone still includes the zone between the orifice plate and the bonded substrate. Another concern relates to the spatial relationship between a heater and an associated orifice. The thermal transfer is at a 90 degree angle to the direction of ink projection. This relationship may adversely affect either or both of the efficiency and the reliability of a firing operation. Furthermore, if the electronic circuitry for controlling ink firing is fabricated onto the ink reservoir wall, there must be hundreds of electrical connections that extend from the ink reservoir wall to the large number of heaters on the orifice plate.

What is needed is an inkjet printhead and fabrication method in which the alignment of an array of ink firing chambers with an array of actuators, such as thermal actuators, is precisely and repeatedly achieved. What is further needed is an inkjet printhead that is less susceptible to long-term failures than printheads that are fabricated by conventional approaches of adhering printhead components together with polymers.

SUMMARY OF THE INVENTION

An inkjet printhead is fabricated in a sequence to integrate actuators and ink firing chambers on a single monolithic substrate, with the volume of ink to be heated and projected from a particular ink firing chamber being defined by the space formed by etching through the substrate in alignment with an associated actuator. That is, the ink firing chambers are formed into the same substrate that includes the array of actuators on one of the substrate surfaces and the walls of each firing chamber are the etched walls through the substrate and the surface of an associated actuator. In the preferred embodiment, the substrate also includes switching devices for driving and/or multiplexing the actuators. In this preferred embodiment, the actuators are thermal actuators and the switching devices are monolithically integrated driver transistors.

According to the preferred method of fabricating the inkjet printhead, electronic circuitry and the array of actuators are formed on an upper surface of a semiconductor-on-insulator (SOI) wafer. The electronic circuitry (e.g., the switching devices) and the layers that are used to define the actuators and the connections from the actuators to the circuitry are fabricated using known integrated circuit fabrication techniques, e.g., photolithography. The ink firing chambers are then anisotropically etched into the semiconductor layer of the SOI wafer. The axis of an ink firing chamber is aligned with the center of an actuator that is associated with the ink firing chamber. After the circuitry, actuators and chambers have been formed, an ink supply manifold is attached and the insulator layer is removed, exposing openings to the ink firing chambers (i.e., exposing nozzles). The supply manifold is connected to a source for replenishing ink to the firing chambers following projection of ink from the openings.

As an alternative to the SOI-based techniques, the inkjet printhead may be fabricated by executing similar steps to provide electronic circuitry, the actuators and the etched chambers in a thick monocrystalline wafer, and then removing a lower portion of the wafer to expose the openings to the ink firing chambers. That is, the structure is fabricated on a substrate formed of a single material, and the substrate is then reduced in thickness.

In one embodiment, the ink firing chambers have well-defined inverted and truncated pyramidal shapes with rectangular openings. The slope of the walls is dictated by the orientation of the (111) crystallographic planes. However, the shape of the ink firing chambers is not critical to the invention. Other chamber configurations are obtainable using known techniques. For example, curved chamber walls may be formed by defining the firing chambers prior to the heaters, with the chambers being carved into the substrate using suitable masking and etching techniques. The chambers may then be temporarily refilled with an appropriate sacrificial material, such as glass, in order to replanarize the wafer for fabricating the actuators.

An advantage of the invention is that the printhead components which require precise alignment are fabricated onto a single substrate, typically a monocrystalline silicon layer. Only those components requiring a coarse fit, e.g., an ink supply manifold, are fabricated independently from the actuator-and-chamber substrate. Another advantage is that the monolithic structure eliminates the possibility of delamination of an orifice layer from an actuator layer, which is a major source of failures in many prior art printheads. The volume of ink that is heated and projected during a firing operation is contained within a substrate and not a region between two substrates which are laminated together. Yet another advantage is that the architecture is amenable to scaling down with the need for smaller and smaller ink drops. It is believed that the actuator-and-chamber substrate may be formed to be as thin as a few microns, and the chamber openings may be as small as one micron. With an appropriate actuator layout, the ink firing chambers may be made to self-align with the actuators. The thickness of the substrate substantially represents the total thickness of the functional portion of the inkjet printhead. The dimensions provide needed flexibility for designing thermal inkjet printheads for small appliances.

Another advantage is that the architecture of the actuator-and-chamber substrate leaves the back surface of the substrate exposed, facilitating the integration of upstream flow control mechanisms, such as valves, regulators, pumps, and metering devices. For example, a valve having one or more flexible flappers may be micromachined to reside between an ink firing chamber and a supply channel for replenishing the firing chamber with fluid ink.

BEST MODE FOR CARRYING OUT THE INVENTION

Figure 1:
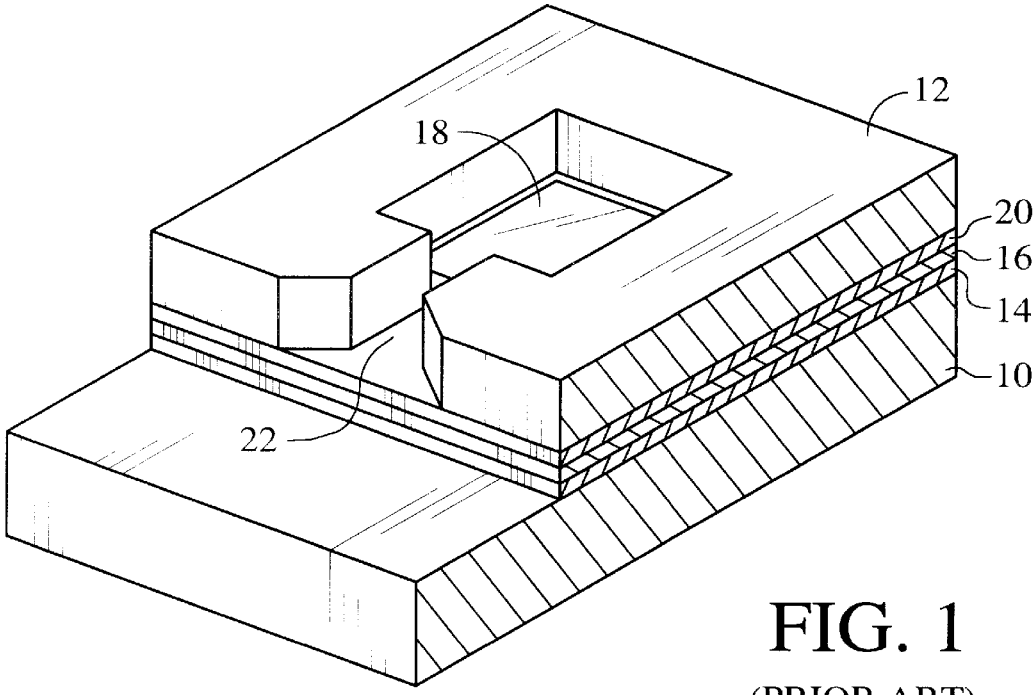
FIG. 1 (PRIOR ART)
FIG. 1 is a perspective view of a prior art inkjet firing mechanism.
Figure 2:
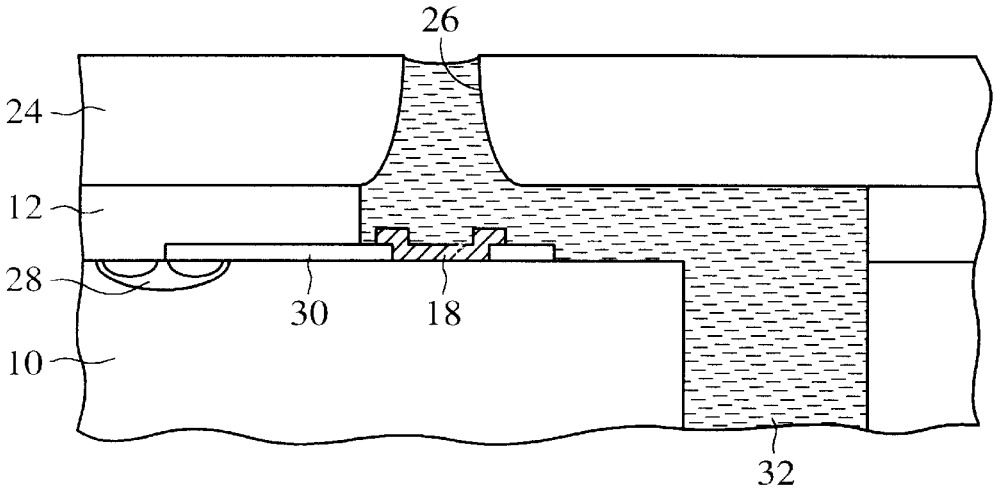
FIG. 2 (PRIOR ART)
FIG. 2 is a side sectional view of a prior art inkjet firing mechanism in operation.

FIGS. 3–8 illustrate the steps employed in fabricating an inkjet printhead in accordance with the invention. In contrast to the prior art structure of FIGS. 1 and 2, the ink firing chamber is formed in the same substrate that contains the actuator and the switching device. While the supply manifold is attached to the substrate, the alignment requirements are significantly relaxed, since the supply manifold includes only one or two ink feeding slots, each common to an entire row of actuators chambers.

As will be explained in detail below, the fabrication steps illustrated in FIGS. 3–8 provide the structure of FIG. 9. FIG. 9 shows a first inkjet mechanism 58 adjacent to a second inkjet mechanism 60. Each of the mechanisms includes a thermal actuator 42 and 62 aligned with an inkjet firing chamber 52 and 64, respectively. The firing of ink from the first inkjet mechanism 58 is controlled by electronic circuitry 48, which may be a bipolar or CMOS device. The electronic circuitry is connected to the thermal actuator 42 by a conductive trace 46. Similarly, the second inkjet mechanism 60 is operatively associated with electronic circuitry 66 that is connected to the thermal actuator 62 by a conductive trace 68.

The thermal actuators 42 and 62 are fabricated directly onto the rear surface of an actuator substrate 36. In the preferred embodiment, the actuator substrate is a silicon substrate, but this is not critical. The substrate may be formed of a polymer or glass.

Integrating the thermal actuators 42 and 62 with the ink firing chambers 52 and 64 eliminates the concern that an actuator substrate will delaminate from an orifice substrate. The volume of ink that is heated and projected from an ink firing chamber during a firing operation is defined by the dimensions of the ink firing chamber through the substrate 36. That is, in the preferred embodiment, no portion of the ink firing chamber is located at an interface between two bonded substrates. This significantly reduces the susceptibility of the inkjet printhead to delamination.

After the projection of ink from one of the firing chambers 52 and 64, a refill process is initiated. Ink flows from an associated supply channel 65 and 67 of a supply manifold 54 to the emptied firing chamber.

The fabrication of the first inkjet mechanism 58 is described in detail with reference to FIGS. 3–8. An array of inkjet mechanisms, including the second mechanism 60, is formed simultaneously with the first mechanism 58. However, illustration of the fabrication steps is limited to the single mechanism.

Figure 3:
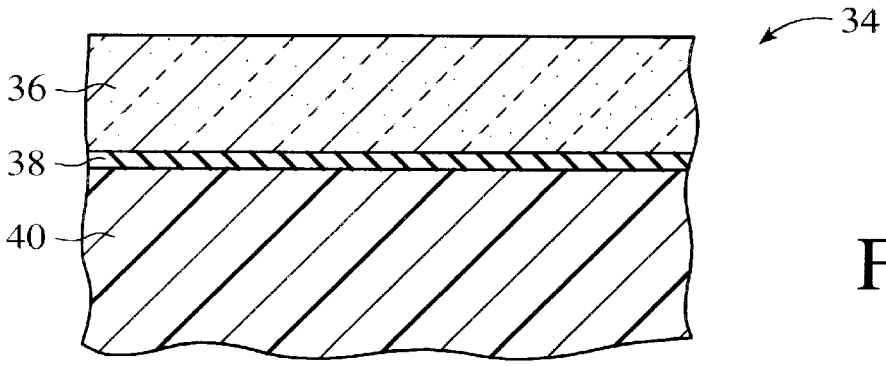
FIG. 3 is a side sectional view of a semiconductor-on-insulator wafer for use in fabricating a thermal inkjet printhead in accordance with the invention.

In FIG. 3, a semiconductor-on-insulator (SOI) wafer 34 is shown as including a semiconductor layer 36, an insulator layer 38, and a handle layer 40. SOI wafers are known in the art and are commercially available. Typically, the semiconductor layer 36 is a monocrystalline silicon material. The insulator layer may be silicon dioxide. The materials for forming the semiconductor and insulator layers are important only with respect to the desired fabrication techniques and the desired final architecture of the inkjet printhead. For example, if a firing chamber having a truncated pyramidal configuration with square nozzles is desired, the selections of the materials for forming layers 36 and 38 are important. Such a configuration can most simply be fabricated by an anisotropic etch into the layer 36. With regard to the handle layer 40, the material is not critical. Conventional handle layers are formed of silicon or glass.

Figure 4:
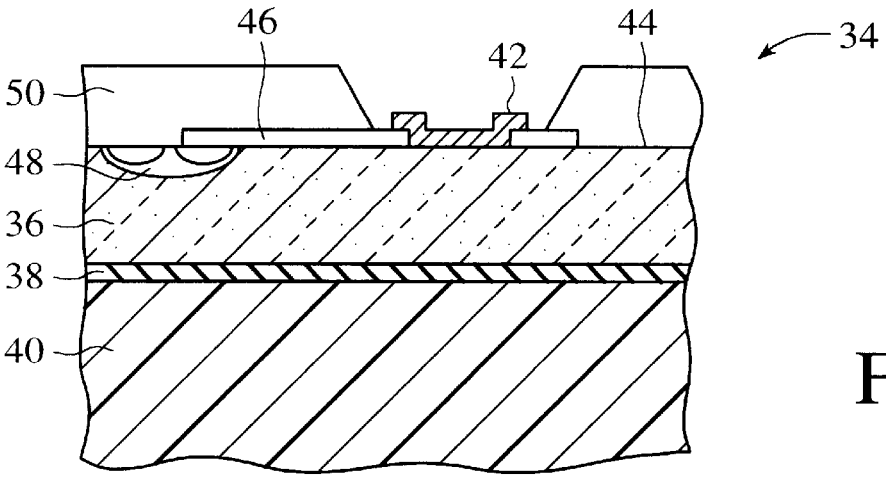
FIG. 4 is a side sectional view of the wafer of FIG. 3 having a switching device and a thermal actuator formed on a surface of the semiconductor layer.
Figure 5:
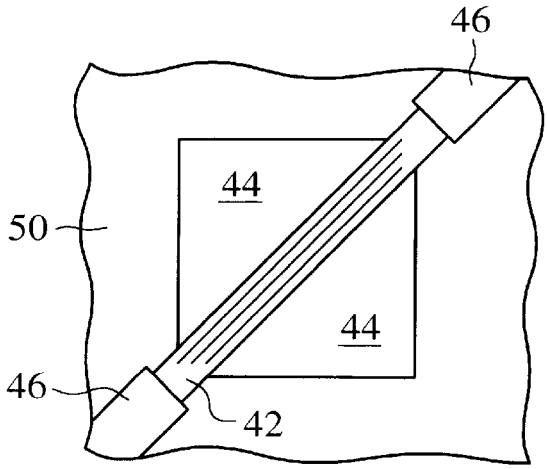
FIG. 5 is a top view of the thermal actuator region of FIG. 4.

In FIG. 4, the thermal actuator 42 has been fabricated onto an upper surface 44 of the semiconductor layer 36. The techniques for forming the thermal actuator are not critical. The material may be tantalum or tantalum aluminum. In addition to the thermal actuator, the conductive trace 46 and the electronic circuitry 48 are formed at the surface 44 of the semiconductor layer 36. The conductive trace may be a multi-layer construction. For example, a thermal underlayer of silicon dioxide may isolate a gold film from the silicon, with an electrical passivation film being formed atop the gold film. The electronic circuitry 48 may be a bipolar or CMOS switching device. Preferably, the electronic circuitry is formed using conventional integrated circuit fabrication techniques. Activation of the electronic circuitry 48 triggers current flow through the actuator 42.

A masking layer 50 is formed on the upper surface 44 of the semiconductor layer 36. A suitable masking material is silicon nitride. As shown in the side view of FIG. 5, the upper surface 44 of the semiconductor layer is exposed at the sides of the conductive trace 46. Consequently, when an etchant is applied to the upper surface of the SOI wafer, portions of the semiconductor layer are removed to form ink firing chambers. A suitable etchant is tetramethyl ammonium hydroxide (TMAH).

Figure 6:
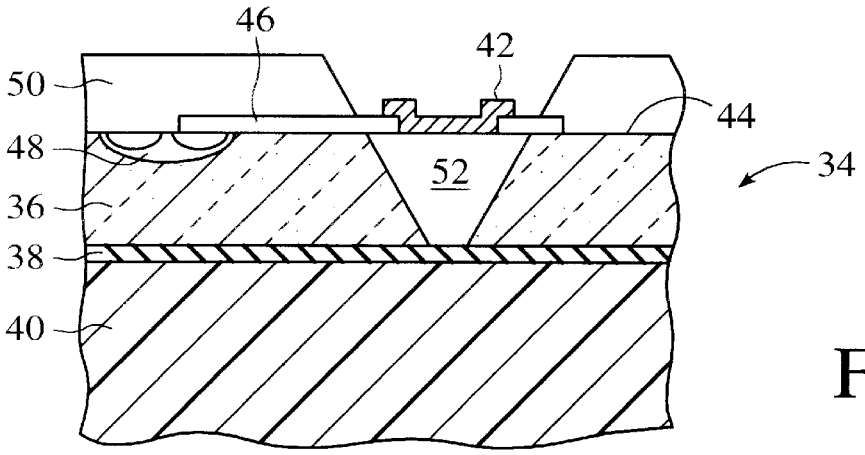
FIG. 6 is a side sectional view of the structure of FIG. 4 having an ink firing chamber formed into the semiconductor layer.

Referring now to FIG. 6, the semiconductor layer 36 is shown as being anisotropically etched to form the ink firing chamber 52. The configuration of the firing chamber is one having a well-defined inverted and truncated pyramidal shape. The shape of the firing chamber at the interface with the insulator layer 38 is a substantially perfect rectangle. The dimensions of the firing chamber are defined by the size of the open window in the masking layer 50 and by the thickness of the semiconductor layer 36.

Figure 7:
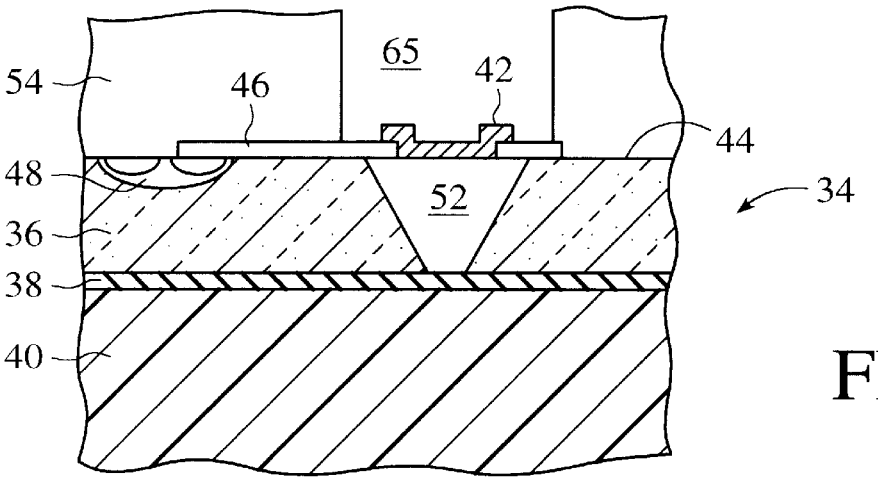
FIG. 7 is a side sectional view of the structure of FIG. 6 having a supply manifold formed on a surface of the semiconductor layer following an optional removal of a masking layer.

Optionally, the masking layer 50 is removed to expose the upper surface 44 of the semiconductor layer 36. An ink supply manifold made of an appropriate inexpensive material can then be attached to the upper surface with relatively relaxed tolerances. Alternatively, the ink supply manifold is attached to the masking layer 50. In FIG. 7, the manifold 54 has been added. A supply channel 65 can be formed for each inkjet mechanism that is formed along the SOI wafer 34, but typically one channel is common to an entire row of ink firing chambers. In one embodiment, the supply manifold 54 is a layer that is grown or otherwise formed on the surface of the wafer. However, typically the supply manifold is a separately fabricated substrate that is adhesively bonded or otherwise attached to the chip. The separate fabrication frees the supply manifold from restrictions that are imposed by techniques feasible in silicon. Preferably, the supply channel is centered with both the actuator 42 and the firing chamber 52. However, precise alignment is not as critical as the alignment of the orifice substrate 24 with the silicon substrate 10 of the prior art inkjet printhead of FIGS. 1 and 2. Alignment tolerances are more relaxed, since some misalignment of the supply channel does not adversely affect the consistency of a firing operation for an inkjet mechanism.

Figure 8:
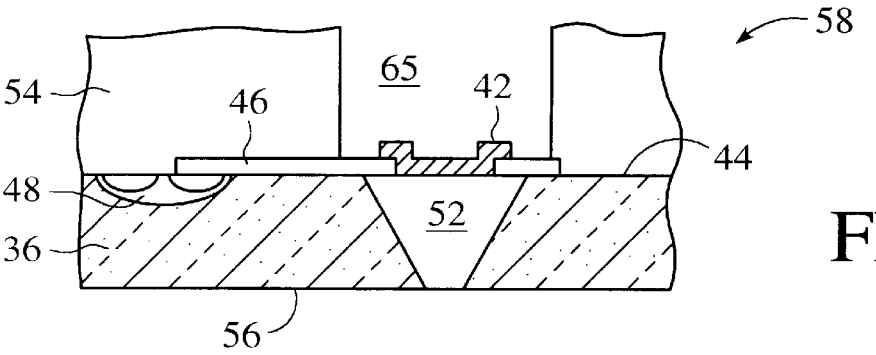
FIG. 8 is a side sectional view of the structure of FIG. 7 after the insulator layer is removed from the wafer.
Figure 9:
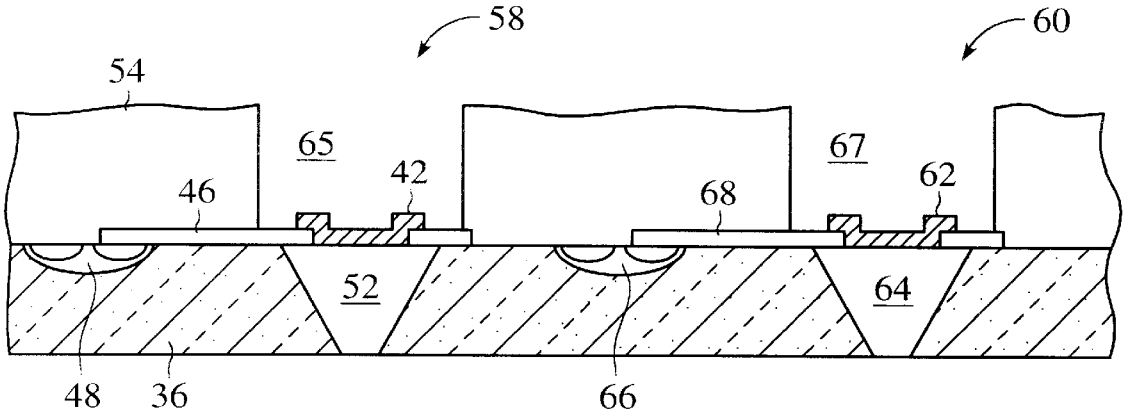
FIG. 9 is a side sectional view of an inkjet printhead having more than one firing mechanism in accordance with the invention.

In FIG. 8, the handle layer and the insulator layer have been removed using known techniques for SOI-based applications. The removal of the insulator layer exposes the lower surface 56 of the semiconductor layer 36 and exposes an opening to the firing chamber 52. As is well known in the art, the shape of the firing chamber is at least partially dictated by the orientation of the (111) crystallographic planes. While the firing chamber has been described as having the pyramidal shape and the square opening, this is not critical. In an alternative fabrication method, the firing chamber is carved into the semiconductor layer 36 prior to formation of the thermal actuators 42. A suitable masking and etching process, such as dry plasma or laser-enhanced etching, may then be used to form chamber configurations other than the pyramidal shape. For example, a chamber having curved walls may be formed and then filled with a sacrificial material, such as glass, to replanarize the wafer surface. The replanarization allows the actuators to be fabricated using the above-identified techniques. The sacrificial material is removed from the firing chambers and the supply manifold is attached to establish the same basic structure as shown in FIG. 7, but with a differently shaped firing chamber. The handle layer 42 and the insulator layer 38 are then removed.

While the fabrication has been described and illustrated as forming a single inkjet mechanism, an array of mechanisms is formed simultaneously along the semiconductor layer 36. Referring now to FIG. 9, the inkjet mechanism 58 of FIG. 8 is shown as being disposed adjacent to a second inkjet mechanism 60. This mechanism includes a thermal actuator 62 aligned with an inkjet firing chamber 64. A switching device 66 is connected to the thermal actuator by a conductive trace 68. The provision of separate switching devices 48 and 66 for the separate inkjet mechanisms 58 and 60 allows the mechanisms to be addressed independently. The projection of ink from one of the firing chambers initiates a refill process in which ink flows through the channels of the supply manifold 54 to an empty firing chamber.

Figure 10:
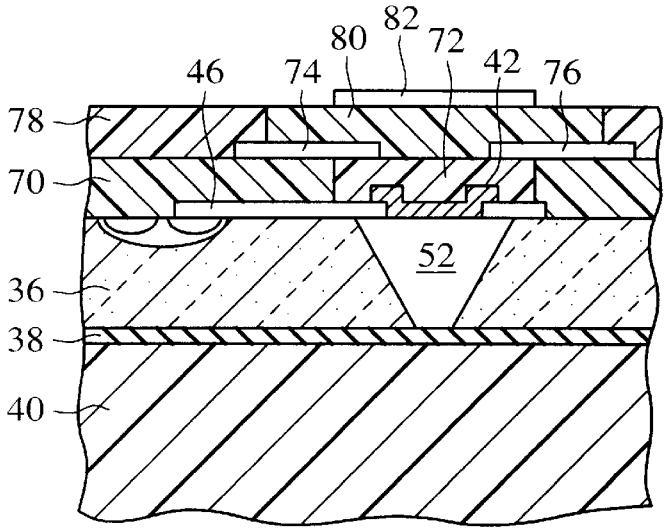
FIG. 10 is a side sectional view of the structure of FIG. 6 following the formation of layers for providing a valve mechanism.

The operation of the inkjet mechanisms 58 and 60 for projecting ink from one of the openings of the firing chambers 52 and 64 involves a complex balance of forces on a microscopic scale. Such variables as atmospheric pressure, ink pressure, and air accumulation in the ink reservoir play important roles in the replenishing of the firing chambers. Small variations in the refill process result in inconsistencies that affect print quality. Moreover, ink "pushback" into the ink reservoir during the firing operation slows down the refill process and is energy ineffective. In order to at least reduce these adverse effects, it is desirable to include certain fluid flow devices upstream from the inkjet chip. In the prior art, such devices would require separate fabrication and assembly onto the inkjet chip or elsewhere in the ink supply system. The integrated architecture of the present invention exposes the upstream side of the inkjet chip, and allows the fabrication of integrated micro-fluidic devices for ink flow control. For example, valves, regulators, pumps and metering devices may be incorporated in order to improve print quality, efficiency and throughput of the printing process. FIGS. 10–13 illustrate fabrication steps for micromachining one such type of flow control mechanism. Returning briefly to FIG. 6, an inkjet mechanism that is to include a flow control device may be formed using the steps which lead to the structure shown in FIG. 6. Optionally, the masking material 50 that is utilized in the etching process for providing the firing chamber 52 is removed to expose the upper surface 44 of the semiconductor layer 36, but the masking layer may be left intact. Rather than attaching a supply manifold to the upper surface 44, layers are deposited and patterned to provide an integrated micro-fluidic check valve. In FIG. 10, a first support layer 70 and a first sacrificial layer 72 are patterned on the surface of the semiconductor layer 36. A pair of flappers 74 and 76 are then formed to extend from atop the first support layer to the upper surface of the first sacrificial layer. While not critical, the flappers may be formed of polysilicon.

Following the formation of the flappers 74 and 76, a second support layer 78 and a second sacrificial layer 80 are deposited. The final deposition is a patterned polysilicon layer that forms a gate 82. The two sacrificial layers 72 and 80 are removed using conventional techniques, and a supply manifold is attached to the upper surface of the second support layer 78. The resulting structure is shown in FIG. 11.

Figure 11:
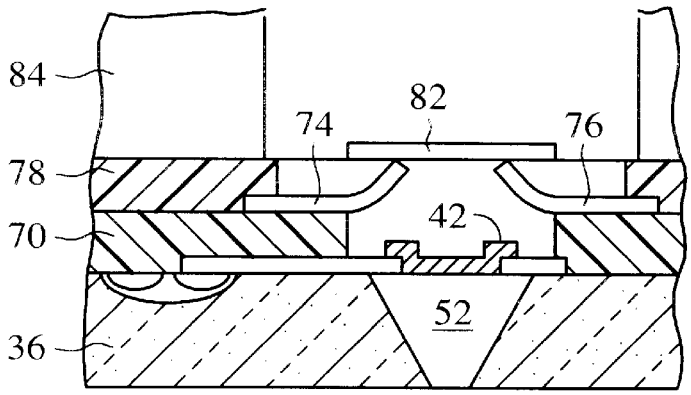
FIG. 11 is a side sectional view of the valve mechanism between the ink firing mechanism and a supply manifold.
Figure 12:
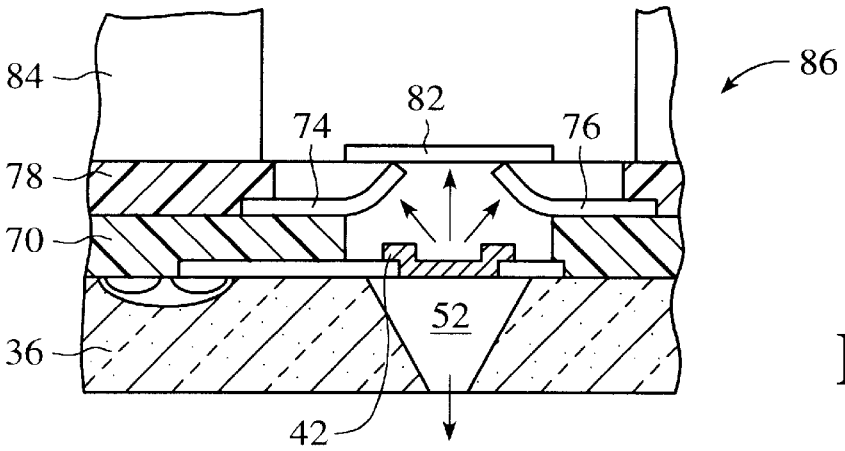
FIGS. 12 and 13 are side sectional views of the structure of FIG. 11, showing the operation of the valve mechanism.

As viewed from the perspective of FIG. 11, the left and right sides of the gate 82 are open to flow from an ink supply manifold 84. On the other hand, the forward and rearward edges of the gate 82 are connected to the upper surface of the second support layer 78 so that fluid flow is limited to the left and right sides of the gate. While not previously described, the polysilicon flappers 74 and 76 are fabricated in a controlled manner to induce film stresses that cause the flappers to curl upwardly following the removal of the sacrificial layers. The degree of induced curl and layer thicknesses may be controlled to provide either a normally open or a normally closed embodiment. In the normally closed embodiment of FIG. 11, the thickness of the second support layer 78 is selected to allow the ends of the flappers to contact the lower surface of the gate 82, thereby closing the lateral flow paths from the supply manifold 84 to the ink firing chamber 52. The back pressure that is exerted during heating of the thermal actuator 42 reinforces the biasing force for closing the lateral flow paths. This back pressure is represented by three arrows in FIG. 12. As a result, ink "pushback" is significantly reduced, most of the applied energy is utilized for drop ejection, and the subsequent refill process is accelerated.

Figure 13:
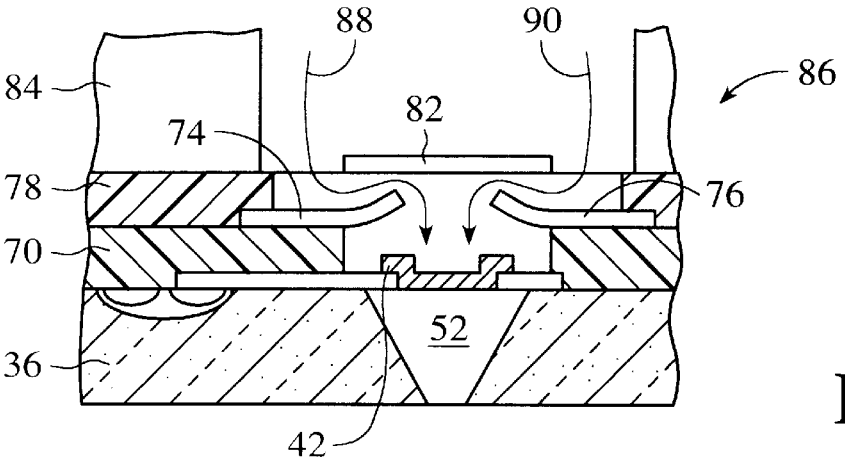

Each ink firing operation is followed by a refill process. In FIG. 13, arrows 88 and 90 show ink flow overcoming the bias of the flappers 74 and 76 to allow the firing chamber 52 to be refilled for a subsequent firing operation.

While the flappers 74 and 76 have been described as having the relaxed condition of FIG. 11 in which the flappers contact the gate 82, this is not critical. The back pressure represented by the three arrows in FIG. 12 may be the means by which fluid flow is sealed from the manifold 84 to the firing chamber 52. In this embodiment, the relaxed conditions of the flappers are spaced apart from the gate 82. That is, rather than a normally closed condition, the micromachined check valve may have a normally open condition, as shown in FIG. 13.

In addition to or as a substitution for the valve, other flow control devices may be micromachined to be incorporated with the inkjet firing structure of FIG. 6 or similar structures having actuators 42 and firing chambers 52 integrated onto a single substrate.

While the actuator-and-firing chamber integration has been described primarily with reference to SOI technology, this is not critical. SOI-based techniques provide advantages (e.g., ease of manufacture) but other techniques that allow the integration may be used. For example, an array of actuators and an aligned array of firing chambers may be formed along a thick semiconductor substrate, whereafter the portion of the substrate opposite to the actuators may be removed. That is, if the actuators are formed on the upper surface of the thick substrate, the lower portion may be lapped or otherwise treated in order to reduce the thickness until the openings to the various firing chambers are exposed and have the desired configuration.

The invention has been primarily described and illustrated as including thermal actuators. However, this is not critical. The integration architecture and process may be employed with other techniques for firing ink from a firing chamber by means of an actuator.

What is claimed is:

1. An inkjet printhead comprising:

a semiconductor substrate having a first surface and a second surface, said first and second surfaces being oppositely directed major surfaces of said semiconductor substrate;

a plurality of heating elements photolithographically formed on said first surface of said semiconductor substrate to define an array of heating elements in parallel with said first surface;

electronic circuitry formed within said semiconductor substrate and connected to said heating elements such that activation of said electronic circuitry triggers current flow through said heating elements said electronic circuitry including a separate switching device for each of said heating elements, said switching devices being individually addressable;

said semiconductor substrate having a plurality of ink firing chambers extending in general alignment with said heating elements and extending through said semiconductor substrate from said first surface to said second surface, each ink firing chamber having a configuration compatible with anisotropic etching to define an area to receive a volume of fluid ink for projection from said ink firing chamber in response to activation of one of said heating elements, each of said ink firing chambers having a truncated pyramidal configuration having a generally rectangular opening at said second surface of said semiconductor substrate, said ink firing chambers being in one-to-one correspondence with said heating elements such that each heating element extends across a corresponding ink firing chamber at said first surface;

a flow control mechanism for each of said ink firing chambers, each said flow control mechanism being positioned over a heating element such that said heating element is situated between said flow control mechanism and an ink firing chamber that corresponds to said heating element; and a supply manifold in fluid communication with each of said ink firing chambers to replenish said ink firing chambers with said fluid ink, said supply manifold including a manifold substrate attached to said first surface of said semiconductor substrate.

2. The inkjet printhead of claim 1 wherein said electronic circuitry includes transistors formed within said semiconductor substrate.

3. The inkjet printhead of claim 1 wherein there is a one-to-one correspondence between said switching devices and said heating elements.

4. The inkjet printhead of claim 1 wherein said flow control mechanism includes a pair of flexible members displaceable between open positions in which a supply of ink is in fluid communication with said ink firing chamber and a closed position in which fluid flow between said ink firing chamber and said supply is inhibited.

* * * * *